US009200222B2

(12) United States Patent
Kuske et al.

(10) Patent No.: US 9,200,222 B2
(45) Date of Patent: Dec. 1, 2015

(54) GASIFICATION REACTOR HAVING DIRECT OR INDIRECT SUPPORT AT COOLANT INLET LINES OR MIXTURE OUTLET LINES

(75) Inventors: Eberhard Kuske, Soest (DE); Johannes Dostal, Dortmund (DE); Reinald Schulze Eckel, Muenster (DE); Lothar Semrau, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 457 days.

(21) Appl. No.: 13/384,434

(22) PCT Filed: Jul. 16, 2010

(86) PCT No.: PCT/EP2010/004340

§ 371 (c)(1),
(2), (4) Date: Jan. 17, 2012

(87) PCT Pub. No.: WO2011/012232

PCT Pub. Date: Feb. 3, 2011

(65) Prior Publication Data

US 2012/0110907 A1 May 10, 2012

(30) Foreign Application Priority Data

Jul. 27, 2009 (DE) ..... 10 2009 034 867

(51) Int. Cl.
*B01J 7/00* (2006.01)
*C10J 3/48* (2006.01)
(Continued)

(52) U.S. Cl.
CPC .. *C10J 3/485* (2013.01); *C10J 3/76* (2013.01); *C10J 3/845* (2013.01); *C10J 2200/09* (2013.01); *C10J 2300/1223* (2013.01)

(58) Field of Classification Search
CPC ..... C10J 3/845; C10J 3/485; C10J 2200/09; C10J 3/76; C10J 3/84; C10K 1/101; F28D 7/0041
See application file for complete search history.

(56) References Cited

U.S. PATENT DOCUMENTS 4,474,584 A * 10/1984 Koog ..... 48/197 R
4,479,536 A 10/1984 Laméris
(Continued)

FOREIGN PATENT DOCUMENTS

DE 35 30 918 5/1986
DE 40 25 916 1/1991
(Continued)

OTHER PUBLICATIONS

International Search Report of PCT/EP2010,004340, date of mailing May 6, 2011.

*Primary Examiner* — Imran Akram
(74) *Attorney, Agent, or Firm* — Collard & Roe, P.C.

(57) ABSTRACT

A cooling shield is to be made available, in particular within the pressure container, with conical regions for the exit of gas or slag, in a gasification reactor (1) for producing crude gas containing CO or $H_2$, having a pressure container (2) and a reaction chamber (4) formed by a membrane wall (3) of cooling pipes, wherein an annular space is formed between the inner wall of the pressure container (2) and the membrane wall (3), wherein elements such as burners (17) or the like are provided, which elements horizontally pass through the pressure container wall in the membrane wall substantially on the same plane (18), wherein the suspension or connection between the cooling shield and pressure container (load removal) is optimized, while avoiding difference expansions. This is achieved in that, for removal of the load on the membrane wall (3), direct or indirect support takes place at the cooling inlet lines (5) or mixture outlet lines (14).

6 Claims, 3 Drawing Sheets

Figure 1:
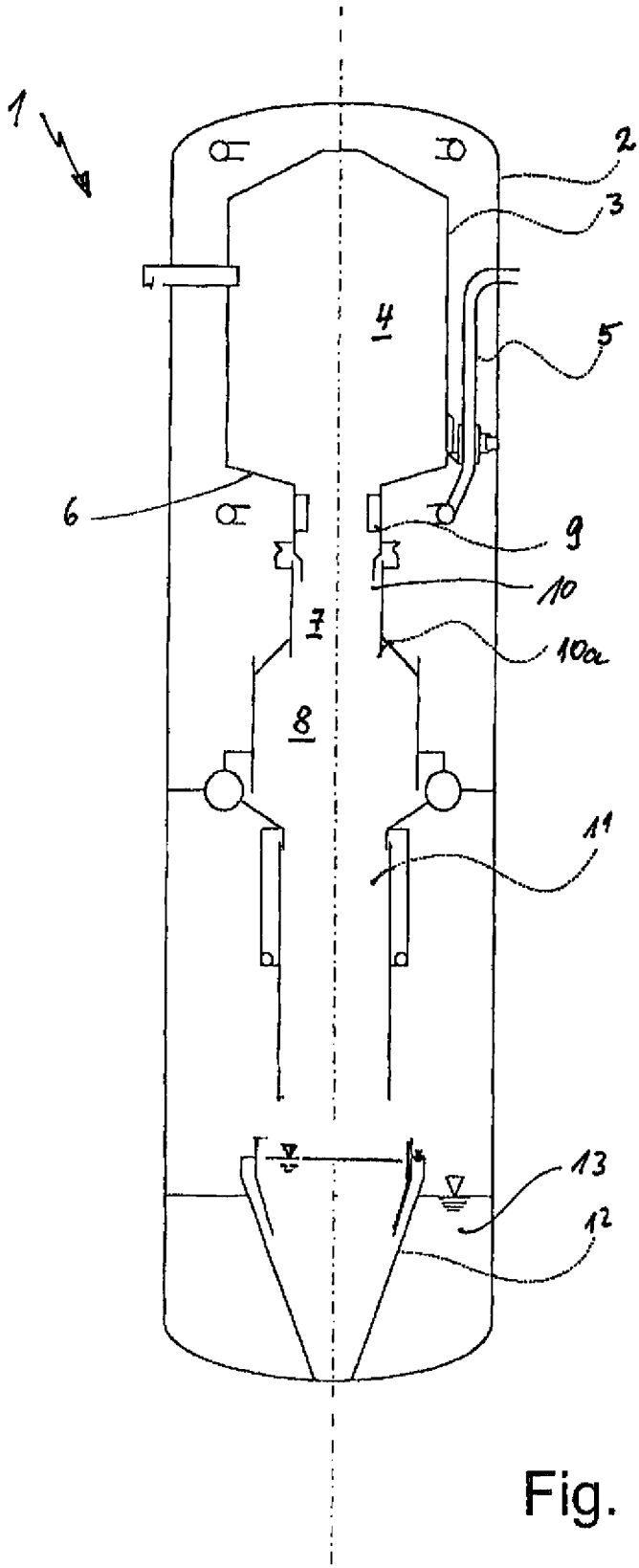

(51) Int. Cl.
*C10J 3/76* (2006.01)
*C10J 3/84* (2006.01)

(56) References Cited

U.S. PATENT DOCUMENTS

| | | | | |
|---|---|---|---|---|
| 4,707,163 | A | 11/1987 | Gudymov et al. | |
| 5,441,547 | A | 8/1995 | Durrfeld et al. | |
| 2008/0005966 | A1 | 1/2008 | Fischer et al. | |
| 2008/0256860 | A1* | 10/2008 | Von Kossak-Glowczewski | 48/201 |
| 2009/0049747 | A1* | 2/2009 | Von Kossak-Glowczewski et al. | 48/77 |
| 2010/0263278 | A1 | 10/2010 | Kowoll et al. | |

FOREIGN PATENT DOCUMENTS

| | | |
|---|---|---|
| DE | 691 02 878 | 2/1995 |
| DE | 10 2006 031 816 | 1/2008 |
| EP | 0 046 600 | 3/1982 |
| EP | 0 616 022 | 9/1994 |
| WO | WO 2009/036985 | 3/2009 |

* cited by examiner

GASIFICATION REACTOR HAVING DIRECT OR INDIRECT SUPPORT AT COOLANT INLET LINES OR MIXTURE OUTLET LINES

CROSS REFERENCE TO RELATED APPLICATIONS

This application is the National Stage of PCT/EP2010/004340 filed on Jul. 16, 2010, which claims priority under 35 U.S.C. §119 of German Application No. 10 2009 034 867.0 filed on Jul. 27, 2009. The international application under PCT article 21(2) was not published in English.

The invention relates to a gasification reactor for producing crude gas containing CO or $H_2$.

Such a gasification reactor is known, for example, from WO 2009/036985 A1 by the applicant, whereby a wealth of prior art is cited in this document, such as U.S. Pat. No. 4,474,584, for example, that in particular addresses the cooling of hot synthesis gas. DE 35 30 918 C3, DE 691 02 878 T2 and EP 0 046 600 B1 are also cited as prior art.

In particular, the invention concerns itself with problems that occur in such reactors, whereby the invention is not restricted to the gasification reactor that is specifically addressed here; it is also directed at apparatuses in which problems described in greater detail below can occur.

Such an apparatus must be suitable to enable methods of pressure gasification/burning of finely distributed fuels, which includes the partial oxidation of the fuels coal dust, finely distributed biomass, oil, tars, or the like in a reactor. This also includes the separate or joint withdrawal of slag or fly ash, and generated synthesis gas or flue gas. Cooling of the reaction products (gas and slag/fly ash) must be enabled, for example by spray quenching, gas quenching, radiation quenching, convective heating surfaces, or the like, depending on the type of method used, whereby finally, attention also has to be directed towards discharge of the reaction products from the pressure container.

The task of the present invention consists in particular of providing a cooling shield within the pressure container, having conical regions for the exit of gas or slag, wherein the suspension or connection between cooling shield and pressure container (load removal) is optimized, while avoiding difference expansions.

This task is accomplished, according to the invention, in that for removal of the load on the membrane wall, support takes place directly or indirectly at the coolant inlet lines or mixture outlet lines, wherein it is practical if the coolant inlet lines and/or the mixture outlet lines are positioned in the neutral plane defined by the burners, for example, and pass through the pressure container there.

By means of the invention, the problem is solved, among other things, of creating a fixed-point plane in the perpendicular line to the container plane, between the pressure container and the inner structures, so that the expansions arising from the extreme temperature differences are absorbed, since there are no or only slight expansion differences in the fixed-point plane. Relative to the pressure container wall, the membrane wall is gas-tight. In contrast, the floor and the cover of such a membrane wall cage have outlets, depending on the design, to allow gas, slag, water, etc. to flow in or out.

By means of the invention, it is clearly possible to pass burners, for example, through the pressure container and the cooling shield during gasification, pressurized pulverized coal combustion, or the like, without having to accept expansions in this connection.

The initially cited problems are partially addressed in EP 0 616 022 B1. Use in a gasification reactor and directly following convective heating surfaces is described here. Here as well, a membrane wall construction is shown that is enclosed on the outside by a pressure container. Here, the load is conducted away from the membrane walls, into the pressure container, by way of separate components. These components are equipped with their own circuits that heat the components. However, this design has the disadvantage that additional circuits beyond the existing ones for the membrane wall must be used, which requires additional space and is extremely complicated.

It is provided, in an embodiment of the invention, that pipes of the membrane wall are fastened to a ring distributor arranged below and/or above the heating surfaces, wherein the ring distributor is connected to the coolant inlet lines or mixture outlet lines.

Fundamentally, the wall designs of the reaction chamber can be configured in different ways; for example, the invention provides a gasification reactor having a membrane wall cage, and having top and bottom conical regions formed by cooling pipes, which membrane wall cage is characterized in that the conical membrane cage regions are equipped with separate cooling water inflows and outflows, wherein a part of the pipes forming the vertical membrane wall are designed as a support element for the pipes forming the bottom or top cone.

It can be seen that a particular feature of this embodiment is that at least a part of the pipes that form the substantially cylindrical membrane wall and through which coolant flows simultaneously bear the bottom membrane cage region by means of support, and the top membrane cage by means of suspension.

In this connection, in an embodiment of this solution, it can be provided that the pipes forming the support elements run out of the respective ring distributor below or above the respective cone and back into the membrane wall, whereby because the pipes forming the support elements are guided out of a different plane of the ring distributor, they always have the optimum angular positions to receive the load of the supported or suspended membrane wall cage region.

In another embodiment of the invention, it is provided, in particular when the membrane is formed from continuous pipes that form both the top and bottom conical region, that brackets are provided in the annular space at the membrane wall pipes, which brackets support themselves on the coolant inlet lines or mixture outlet lines, wherein it can also be provided that the membrane wall and the top and bottom conical region are formed by the same coolant-conducting pipes, wherein regions of the corresponding pipe segments are arranged offset or shifted from one another to form the respective cone, whereby the cone formation can be optimized using simple means.

Figure 2:
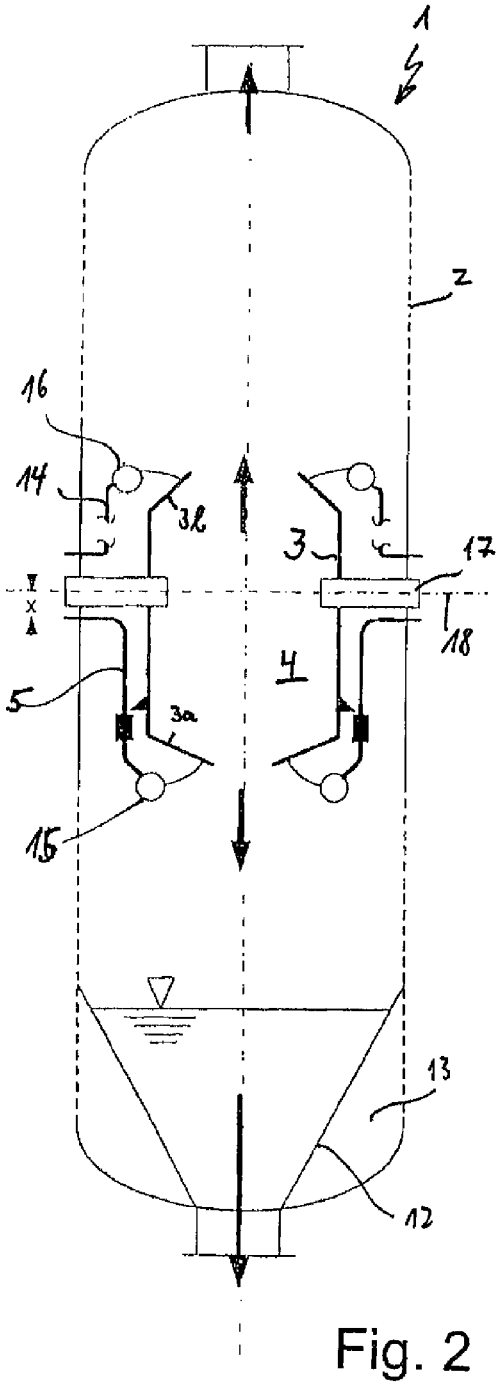
Figure 3:
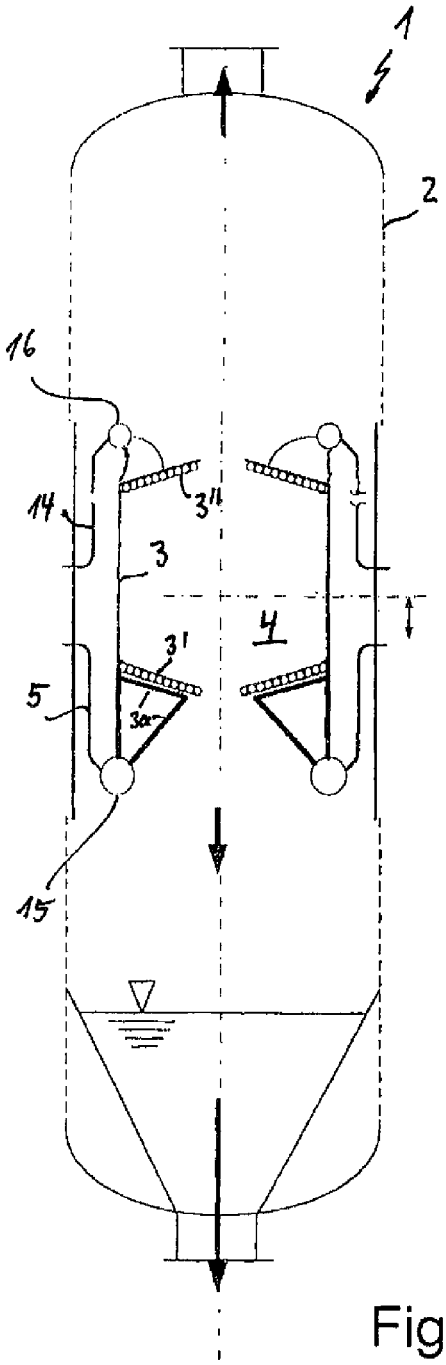

Further details, features and advantages of the invention are evident from the following description and the drawing. This shows, in:

FIG. 1 a schematic drawing of a section of a gasification reactor according to the invention, FIGS. 2 and 3 schematic representations of a gasification reactor having differently configured reaction chambers, and FIGS. 4 to 7 schematic drawings in a half section of the reaction chambers, having different pipe layouts.

The gasification reactor shown in FIG. 1, generally identified as 1, has a pressure container 2, in which a reaction chamber 4 enclosed by a membrane wall 3 is disposed at a distance from the pressure container 2, from top to bottom. The coolant feedline to supply the membrane wall 3 is identified as 5. In this connection, the membrane wall 3 transitions, via a bottom cone 6, into a narrowed channel, as part of a transitional region identified as 8, whereby spin brakes 9 are indicated in the narrowed transition channel 7. 10*a* identifies a drip edge at the transition region 8 for the liquid ash, in the transition region, at a distance from the first drip edge 10, at the end of the transition channel 7.

Following the transition region 8 is a quench chamber or quench channel 11, followed by a slag collection container 12 in a water bath 13.

In the following, the embodiment of the membrane wall 3 enclosing the reaction chamber 4 will be described, in particular.

In the exemplary embodiment according to FIG. 2, the membrane wall 3 is formed by pipes indicated merely as a solid line, through which coolant medium flows, which pipes simultaneously form top and bottom conical regions 3*a* and 3*b*, wherein feed of the coolant takes place by way of coolant inlet lines 5, the mixture outlet lines are identified with 14, wherein these lines are supplied from a top and bottom ring distributor 15 and 16, respectively.

Any elements passing through the wall of the pressure container 2 and membrane wall 3, such as burners or the like, are merely indicated in FIG. 2 and identified with 17. The horizontal plane defined by these installed elements is indicated by a broken line and identified with 18.

The inlets and outlets, respectively, of the coolant inlet lines 5 and mixture outlet lines 14, respectively, pass through the pressure container wall 2 within this plane 18, or as close as possible to the plane 18, and the geometric assignment is identified with "x" in FIG. 2.

The exemplary embodiment according to FIG. 3 is configured somewhat differently. Here, the top and bottom cone, identified with 3' and 3" in FIG. 3, are formed by separate cooling pipe systems that are connected in gas-tight manner to the membrane wall 3, and are equipped with their own coolant supply and removal, which is not shown in any greater detail.

A solution is indicated in FIG. 3, in which the bottom cone 3' is borne by multiple cooling pipes that are bent, for example, to form an angle in alternating sequence, and are passed out of the membrane wall 3 below the bottom cone 3', for its support, and back into the bottom ring distributor 15; these pipe pieces are identified with 3*a* in FIG. 3.

The design can also apply analogously to the top cone 3", which is not shown in any greater detail in the figures.

A highly significant feature of the invention is that for removal of the load on the membrane wall 3, the coolant inlet lines 5 or mixture outlet lines 14 are used directly, which is shown in different variants in FIGS. 4 to 7.

Figures 4, 5, 6, 7:
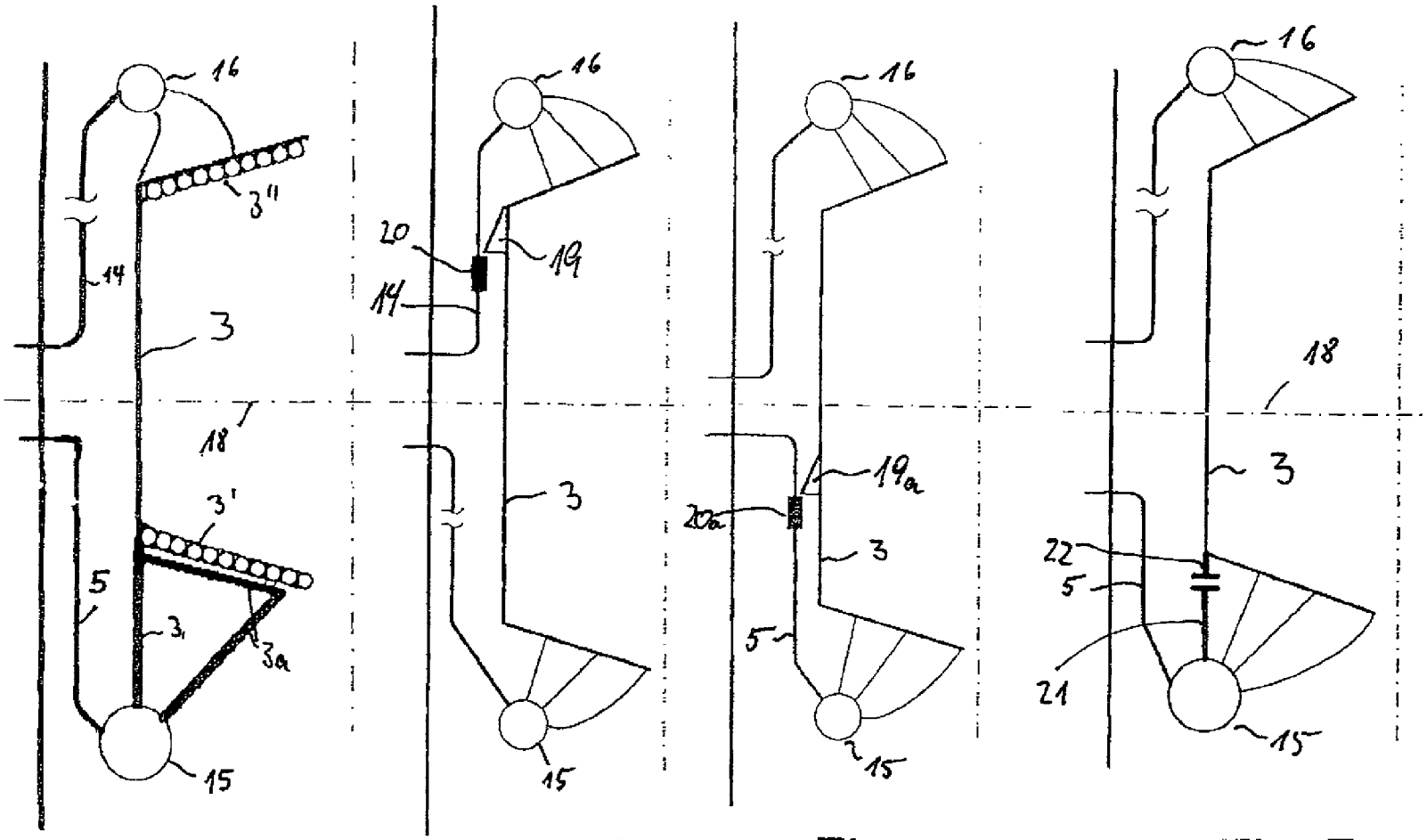

FIG. 4 shows a three-part membrane wall cage having a cylindrical region 3, a bottom cone 3', and a top cone 3", each having their own piping, wherein these conical regions are connected in gas-tight manner to the cylindrical wall.

To support the bottom conical region 3', part of the pipes forming the cylindrical membrane wall 3 are guided out of the plane, bent approximately in the shape of an angle, and into the bottom ring distributor 15, wherein the greater part of the pipes of the vertical membrane wall 3 end in this ring distributor, without a bend. The ring distributor 15 itself is borne by a plurality of coolant inlet lines 5, whereby the overall structure is correspondingly held.

The inlet or outlet of the corresponding lines 5 or 14, respectively, should be positioned in or close to the neutral plane 18 drawn with a broken line, in order to avoid or absorb difference expansions.

A modified example is shown in FIG. 5. Here, the membrane cage is fabricated with a top and bottom cone made of continuous cooling pipes. In the example in FIG. 5, the membrane cage, in particular the cylindrical membrane wall 3, has support brackets 19 in its top region, wherein the outlet lines 14 have corresponding supports 20 against which the support brackets 19 brace themselves, in order to thereby support the entire membrane cage, as well.

FIG. 6 shows a modified exemplary embodiment. Here, the brackets 19*a* are held by supports 20*a* that, however, are positioned here on the respective coolant inlet line 5, in order to also support the entire membrane cage in this way.

Finally, FIG. 7 shows another example in which support elements 21, which themselves may have coolant flowing through them, are positioned on the bottom ring distributor 5, on which elements corresponding supports 22 on the membrane body 3 support themselves.

Of course, the exemplary embodiments of the invention that are described can be modified in many ways, without departing from the basic idea. For example, mixed forms of support can also be provided, such as supports of the bottom membrane wall cage region 3' on bent coolant lines, on the one hand, and possibly additional supports 19 and 20, for example as a combination of the embodiments in FIG. 4 and FIG. 6, on the other hand, to mention only one possible example.

The invention claimed is:

1. A gasification reactor for producing crude gas, containing CO or $H_2$, by gasification of ash-containing fuel with oxygen-containing gas, at temperatures above the melting temperature of the ash, said gasification reactor comprising:

a pressure container comprising an inner wall;

a membrane wall forming a reaction chamber and comprising a first set of cooling pipes;

an annular space formed between the inner wall of the pressure container and the membrane wall;

burners horizontally passing through the inner wall of the pressure container and the membrane wall, substantially on the same plane and creating heating surfaces; and coolant inlet lines and mixture outlet lines;

wherein the membrane wall is supported directly or indirectly at the coolant inlet lines or the mixture outlet lines; and wherein the coolant inlet lines and the mixture outlet lines enter the inner wall of the pressure container within the plane defined by the burners.

2. The gasification reactor according to claim 1, wherein the first set of cooling pipes of the membrane wall are fastened to a ring distributor disposed below and/or above the heating surfaces, wherein the ring distributor is connected to the coolant inlet lines or the mixture outlet lines, respectively.

3. The gasification reactor according to claim 2, further comprising a membrane wall cage and top and bottom conical regions formed of a second set of cooling pipes, wherein the conical top and bottom regions are designed with separate cooling water inflows and outflows, wherein a part of the first set of cooling pipes forming the membrane wall comprises bearing elements for the second set of pipes forming the bottom or top conical regions.

4. The gasification reactor according to claim 3, wherein the first set of pipes forming the bearing elements run separately out of the ring distributor, below or above the bottom or top conical regions, and back into the membrane wall.

5. The gasification reactor according to claim 3, wherein the first set of cooling pipes of the membrane wall and the second set of cooling pipes of the top and bottom conical regions are formed of the same coolant-conducting pipes, wherein the second set of cooling pipes forming the top and bottom conical regions are arranged offset or shifted in regions in relation to one another.

6. The gasification reactor according to claim 1, wherein in the annular space, brackets are provided to support themselves on supports on the coolant inlet lines or the mixture outlet lines.

* * * * *